US005525661A

United States Patent [19]

Lee

[11] Patent Number: 5,525,661

[45] Date of Patent: Jun. 11, 1996

[54] POLYMER SOLUTION FOR SIZING PAPER

[75] Inventor: Kang I. Lee, Longmeadow, Mass.

[73] Assignee: Monsanto Company, St. Louis, Mo.

[21] Appl. No.: 427,311

[22] Filed: Apr. 21, 1995

Related U.S. Application Data

[63] Continuation-in-part of Ser. No. 137,333, Oct. 18, 1993, abandoned.

[51] Int. Cl.[6] ..... C08L 41/00; C08L 43/00

[52] U.S. Cl. ..... 524/547; 524/555; 524/558; 524/559; 526/240; 526/272; 526/318; 526/320

[58] Field of Search ..... 524/547, 558, 524/559, 555; 525/327.7, 329.5, 384; 526/240, 318, 320, 272

[56] References Cited

U.S. PATENT DOCUMENTS

| | | | |
|---|---|---|---|
| 3,342,787 | 9/1967 | Muskat | 524/549 |
| 3,388,106 | 6/1968 | Muskat | 525/327.7 |
| 3,392,155 | 7/1968 | Muskat | 525/327.7 |
| 3,399,109 | 8/1968 | Zimmerman et al. | 525/327.7 X |
| 3,446,783 | 5/1969 | Kay et al. | 526/272 |
| 3,563,937 | 2/1971 | Nickerson | 524/377 |
| 3,650,970 | 3/1972 | Pratt et al. | 525/327.7 X |
| 3,660,339 | 5/1972 | Schuh, Jr. | 525/327.7 X |
| 4,734,204 | 3/1988 | Lamb | 525/327.7 X |
| 5,068,168 | 11/1991 | Lee | 430/270 |
| 5,237,024 | 8/1993 | Allberry et al. | 526/75 |

FOREIGN PATENT DOCUMENTS

| | | | |
|---|---|---|---|
| 991908 | 5/1965 | United Kingdom | 525/327.7 |

*Primary Examiner* Judy M. Reddick
*Attorney, Agent, or Firm* Michael J. Murphy

[57] ABSTRACT

Paper surface sizing properties of aqueous solutions of high molecular weight (at least 100,000 Daltons weight average) styrene-maleate half ester polymers are improved by forming the maleate half ester using oxyalkylene-alkyl alcohol, preferably 2-(n-butoxy) ethyl alcohol.

7 Claims, No Drawings

POLYMER SOLUTION FOR SIZING PAPER

This is a continuation-in-part of application Ser. No. 08/137,333 filed on Oct. 18, 1993 and now abandoned.

BACKGROUND OF THE INVENTION

This invention relates to paper sizing formulations and more particularly to aqueous alkaline solutions of polymers of styrene and maleate half eaters for such applications.

Alkaline salt solutions of high molecular weight styrene-maleic half ester copolymers for sizing paper are known. See, for example U.S. Pat. No. 5,237,024, issued Aug. 17, 1993 where $C_1$–$C_{18}$ alcohols are used in forming the maleic hair ester. Ease of synthesis of these polymers without loss of sizing properties is of continuing interest in the paper sizing art.

SUMMARY OF THE INVENTION

Now improvements have been made in further enhancing the properties of paper sizing formulations.

Accordingly, a principal object of this invention is to provide an improved aqueous alkaline paper sizing solution of styrene-maleate half ester polymers.

Other objects will in part be obvious and will in part appear from the following detailed description and claims.

These and other objects are accomplished by providing an aqueous solution of polymer for sizing paper wherein the polymer has a weight average molecular weight of at least 100,000 Daltons, preferably 150,000 to 250,000 Daltons, and comprising the following recurring units of formula:

A

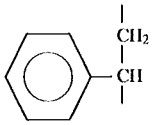

B

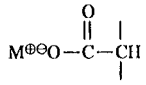

C

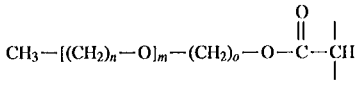

D

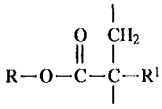

in proportions such that the mole fractions of units A, B, C and D are respectively: 0.45 to 0.83; 0.15 to 0.35; 0.10 to 0.40; and 0 to 0.20; and wherein n, m and o are integers within the following ranges: n=1 to 10; m=1 to 10 and o=1 to 4; R is $C_1$ to $C_3$ alkyl; $R^1$ is H or $C_1$ to $C_3$ alkyl and M is K, Na or $NH_4$.

DETAILED DESCRIPTION

The maleic anhydride partial ester component of the polymers of the solutions of the invention is prepared by partially esterifying maleic anhydride with an oxyalkylene-alkyl alcohol of the formula:

I

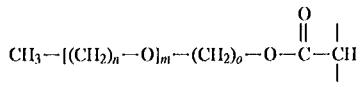

In the above formula n and m are each from 1 to 10 and o from 1 to 4. Preferred ranges of m and n are 1 to 4 and of o, either 1 or 2. In the most preferred form of I, n=3, m=1 and o=2, i.e. 2-(n-butoxy) ethyl maleate. Oxygen atoms in the oxyalkylene, (i.e. $(CH_2)_n$—O) side chains of component C of the polymer enhance the flexibility of such side chains to preserve polymer solubility in the final solution while at the same time providing alkylene ($CH_2$) groups to promote hydrophobicity of the polymer which aids in helping keep water from the sizing solution and ink from smearing on the surface of the paper to which the formulation is applied.

Though preferred (for ease of synthesis in minimizing reaction medium viscosity when using solution polymerization) to form the maleate half ester of the polymer using only the oxyalkylene-alkyl alcohols of formula I, mixtures of the latter with one or more primary or secondary $C_1$–$C_{18}$ alcohols can be used. Usable primary alcohols include methanol, ethanol, n-propanol, n-butanol, isobutanol, n-pentanol, n-hexanol, n-heptanol, n-octanol, n-decanol and higher alcohols up to n-octadecanol. Usable secondary alcohols include isopropanol, secondary-butanol, etc. When alcoholic mixtures are used, the molar ratio of oxyalkylene-alkyl maleate to $C_1$–$C_{18}$ maleate should be 0.5:1 to 4:1, preferably 1:1 to 2:1.

Optionally includable with the styrene and maleate half ester components of the polymer is copolymerizable monomer of the formula:

II

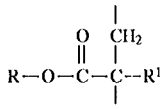

wherein R is $C_1$ to $C_3$ alkyl and $R^1$ is H or $C_1$ to $C_3$ alkyl. Representative compounds satisfying this formula include methyl methacrylate, ethyl methacrylate, methyl acrylate, ethyl acrylate, methyl maleate, ethyl maleate, propyl maleate and butyl maleate. Inclusion of such copolymerized monomer can further improve the sizing properties of the solutions of the invention.

The mole fractions of the polymerized monomers in the polymer are 0.45 to 0.83 (preferably 0.50 to 0.75) styrene, 0.20 to 0.60 (preferably 0.30 to 0.45 maleic half ester) and 0.00 to 0.30 (preferably 0.05 to 0.15) acrylate or methacrylate component.

The polymers of styrene-oxyalkylene-alkyl maleate half ester are prepared by any conventional free radical process providing relatively high molecular weight polymers of at least a molecular weight of 100,000 (weight average) determined by size exclusion chromatography using tetrahydrofuran as solvent and low angle laser light scattering with a Waters Model 401 Differential Refractive Index Detector instrument. Preferably, the polymers are prepared by in situ esterification of maleic anhydride with oxyalkylene-alkyl alcohol followed by solution polymerization of the mixture with styrene at a temperature in the range of 70 to 150° C. using peroxide or hydroperoxide initiators or mixtures thereof, such as t-butyl peroctoate, benzyl peroxide, t-butyl hydroperoxide, t-butyl peroxide, cumene hydroperoxide and cumene peroxide or azo-dinitriles such as azo-di(isobutyronitrile) and azo-di (cyclohexanecarbonitrile).

The polymeric salt is formed by mixing the polymer in aqueous alkaline solution, preferably without the presence of additional components. In doing so, the acid component reacts with the alkaline metal or ammonium of the polymer providing an ester group attached to one C atom and an alkali metal or ammonium cation associated with a carboxylic group. The concentration of polymer salt in solution is 5 to 20 weight percent.

Exemplary of the invention are the following specific examples.

EXAMPLE 1

A) Preparation of Aqueous Ammonium Salt Solution of a Copolymer of Styrene and Mono 2-(n-Butoxy) Ethyl Maleate Maleic anhydride (85.05 gm, 0.87 mole) and 2-butoxyethanol (102.82 gm, 0.87 mole) were charged to a kettle. The reaction mixture is heated to 140° C. and a 30° to 40° C. exotherm allowed to occur. The solution was then cooled to 140° C. and maintained at 140° C. for one additional hour. At the end of this esterification step forming the mono-2-(n-butoxy) ethyl ester of maleic anhydride, the solution was cooled to room temperature. In a separate kettle, styrene monomer (29.50 gm, 0.28 mole) and xylene (118.40 gm) were added to the 50.50 gm of the maleic anhydride half ester solution. A solution of tert-butyl peroctoate (1.60 gm) catalyst in xylene (3 ml) was added to the kettle through an addition funnel in three separate 1 ml slugs at 0, 1 and 2 hours of the reaction time, while the reaction temperature was maintained at 95° C. After complete addition of catalyst, the polymerization mixture was heated at the refluxing 140° C. for an additional one hour. After the reaction mixture was cooled, polymer conversion analysis was determined from an aliquot sample both gravimetrically and by gas chromatograph (GC). Conversion was 100% gravimetrically and 99.99% by residual styrene analysis with GC from an aliquot of polymer solution. Mole fraction analysis of the polymer was: styrene=0.55; mono-2-(n-butoxy) ethyl maleate=0.45. From such aliquot, the polymer was dissolved in ethylacetate and precipitated in hexane and the solid polymer filtered and dried. Molecular weight (weight average) was 150,000 by size exclusion chromatography using polystyrene as standard. The infrared spectrum of the polymer exhibited the ester carbonyl band at 1735 $cm^{-1}$, the acid carbonyl band at 1710 $cm^{-1}$ and styrene band at 700 $cm^{-1}$.

The agitated kettle containing the above polymer solution was fitted with a distillation apparatus and concentrated 30% ammonium hydroxide (10.65 gm) and 85° C. tap water (425.6 gm) was charged over a 10 min. period. Since xylene is essentially immiscible in water, after agitation was stopped a two layer mixture was formed of the solvent and water solution. The xylene layer was decanted off and the residual xylene was further removed from the water solution layer by distillation at 100° C. The resulting aqueous ammonium salt solution was cooled to 25° C. and pH adjusted to 9.2. The solution was water clear to the eye and had a brookfield viscosity of 30 cps (0.03 Pa.s). Residual xylene in the solution was less than 0.01 wt. % by gas chromatography. Mole fraction analysis of A, B, C and D corresponding in formula to the units identified above was: A=0.550; B=0.225; C=0.225 and D=0.

B) Preparation of the Aqueous Ammonium Salt Solution of Styrene-Mono-2-(n-butoxy) ethyl Maleate-Methyl Methacrylate Copolymer Maleic anhydride (45.1 gm, 0.46 mole), styrene (145.6 gm, 1.4 mole) and methyl methacrylate (14 gm, 0.14 mole) were charged to an agitated kettle and heated to 60° C. to ensure melting of all the maleic anhydride. Tert-butyl peroctoate (2 gm) and methyl ethyl ketone (500 ml) were added and the mixture heated to 105° C. under a nitrogen atmosphere. Polymerization was evident by an increase in viscosity of the reaction mixture. After 5 hrs the batch was cooled to room temperature. The viscous syrupy solution was coagulated in a large quantity of hexane. The polymer was precipitated and dried in a vacuum over night. Analysis showed styrene/maleic anhydride/methyl methacrylate mole ratios of 0.71/0.22/0.07 by integrating peaks of the NMR spectrum.

The above prepared styrene-maleic anhydride-methyl methacrylate terpolymer (120 gm), 2-butoxyethanol (8.66 gm) and water (800 gm) were charged to a kettle and heated to the refluxing temperature for 3 hours. After cooling to 80° C., thirty percent aqueous ammonium hydroxide (54 gm) was added through an addition funnel over 2 hours to form a homogeneous translucent solution. When the solution temperature reached room temperature, the pH was adjusted to 9.5 with thirty percent aqueous ammonium hydroxide. The infrared spectrum of the isolated solid shows an ester carbonyl stretching band at 1735 $cm^{-1}$, carboxylic salt carbonyl stretching band at 1450 $cm^{-1}$, and the ether band at 1100 $cm^{-1}$.

EXAMPLE 2

Evaluation of Amide-Ammonium Polymeric Salt Solutions As Paper Surface Sizing Agent

A) Hercules Sizing Test

Ten gm of corn starch in 100 gm of water were heated at 90° C. for 30 minutes. To aid miscibility the starch solution was diluted with an additional 100 gm of water. Then the pH of the solution was adjusted with caustic soda to 8. 10 gms of the ester/ammonium salt of the polymer of Examples 1A and 1B above as a 10% solids concentration in water were mixed with the starch solution to prepare the surface sizing formulations. The surface sizing solution was held in a 55° C. water bath until used in the size press. The press used was a horizontal size press which is a two roll metering device which applied the surface sizing solution to paper sheet as the latter passes downwardly through a nip defined between a sheet contact surface of a first roll and a sheet contact surface of a second roll. The rolls turn in opposite direction in the horizontal plane. The above-prepared surface sizing solutions were applied to the paper stock (alkaline paper containing 12% precipitate calcium carbonate, 0.5% alum and 0.03% alkyl ketene dimer) through the horizontal size press at 90° C. The amount of sizing solution taken up by the paper was 0.09 gm per square meter. The paper was redried after application of the alkaline sizing solution.

The sized paper was tested for ink penetration using a Hercules sizing test apparatus. In this test (conducted at 23° C.), the change is noted in light reflection from the surface of one side of the sized paper sample as ink or a colored solution of naphthol green dye (to simulate ink) is allowed to penetrate from the other side. The naphthol green dye is confined within a ring on the top side of a section of sized paper and the change in light reflectance from the bottom side is measured photoelectrically. An end point of 80% reduction in reflected light is chosen. The reflectance measuring system includes a timer measuring seconds which stops automatically when the reflected light falls below 80%. The time in seconds which has passed from the start of the test until the point at which reduction in reflected light is 80% is recorded. The higher the number of recorded seconds, the better is the performance of the sizing agent in the test. Six samples are tested and the result is the average thereof. In the present Example, such elapsed time was 105 sec. for polymer 1A and 110 sec. for polymer 1B.

B) Contact Angle Measurement Test

This measures the hydrophobicity of the sizing agent. Samples for analysis were prepared by spin-coating the polymer solution onto a clean glass slide using a Headway spinner. Then the samples were dried in air at 23° C. and 45±5% relative humidity. Then the samples were checked under an optical microscope for microcracks and those showing signs of cracks were redone at a slower rpm. Static contact angel measurements were made using a Rame-Hart Goniometer. The contact liquid used to study the time dependence of contact angle was de-ionized water. Small drops of the liquid (approximately 4.0 mm in diameter) were placed on the prepared sample using a microsyringe and the initial contact angle immediately noted. Time dependent measurements of the contact angles were performed in the range of 0.5 to 10 min. thereafter. The higher the contact angle, the better is considered the performance, or considered alternatively, the slower the rate of decrease in contact angle the better is considered the sizing efficiency. Results obtained were as follows:

| Time (Min.) | Polymer 1A Contact Angle (deg.) | Polymer 1B Contact Angle (deg.) |
|---|---|---|
| 0 | 68 | 71 |
| 0.5 | 68 | 71 |
| 1.0 | 66 | 71 |
| 2.0 | 66 | 70 |
| 3.0 | 64 | 68 |
| 4.0 | 62 | 66 |
| 5.0 | 62 | 65 |
| 6.0 | 59 | 64 |
| 7.0 | 59 | 63 |
| 8.0 | 58 | 63 |
| 9.0 | 58 | 63 |
| 10.0 | 58 | 63 |

From the above data, the rate of decrease of contact angle with time shows the superior hydrophobic character of the formulations of the Example, which in turn results in desirable sizing properties.

EXAMPLE C1

This control example, not according to the invention, evaluates performance in the tests described above of solutions containing the ammonium salt of styrene/maleic anhydride/methyl methacrylate terpolymer as disclosed in copending U.S. application Ser. No. 07/972,338, filed Nov. 6, 1992, assigned to the assignee of the present invention, now U.S. Pat. No. 5,290,849.

A terpolymer of styrene, maleic anhydride and methyl methacrylate was prepared as disclosed in Example 1, of the subject patent as was the amide/ammonium salt solution of such terpolymer, the content of which is incorporated herein by reference.

Results of the Hercules Sizing Test with this formulation was 80 sec. Contact Angle Measurement Test results were:

| Time (min.) | Contact Angle (deg.) |
|---|---|
| 0 | 49 |
| 0.5 | 48 |

-continued

| Time (min.) | Contact Angle (deg.) |
|---|---|
| 1.0 | 47 |
| 2.0 | 42 |
| 3.0 | 38 |
| 4.0 | 33 |
| 5.0 | 32 |
| 6.0 | 30 |
| 7.0 | 28 |
| 8.0 | 26 |
| 9.0 | 25 |
| 10.0 | 25 |

The rate of decrease of the contact angle with time is undesirably much faster than that of invention Examples 2A and 2B.

The preceding description is for illustration only and is not to be taken in a limited sense. Various modifications and alterations will be readily suggested to persons skilled in the art. It is intended, therefore, that the foregoing be considered as exemplary only and that the scope of the invention be ascertained from the following claims.

I claim:

1. An aqueous solution for sizing paper consisting essentially of polymer having a weight average molecular weight of at least 100,000 Daltons comprising the following recurring units of formula:

A

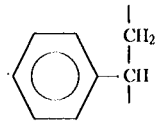

B

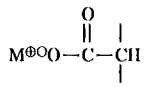

C

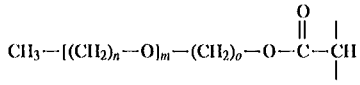

D

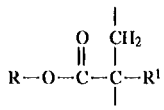

in proportions such that the mole fractions of units A, B, C and D are respectively: 0.45 to 0.75; 0.15 to 0.35; 0.10 to 0.40; and 0 to 0.20; and wherein n, m and o are integers within the following ranges: n=1 to 10; m=1 to 10; and o=1 to 4; R is $C_1$ to $C_3$ alkyl; $R^1$ is H or $C_1$ to $C_3$ alkyl and M is K, Na or $NH_4$.

2. The aqueous solution of claim 1 wherein M is $NH_4$.

3. The aqueous solution of claim 1 wherein n=1 to 4; m=1 to 4 and o=1 or 2.

4. The aqueous solution of claim 3 wherein n=3, m=1, and o=2.

5. The aqueous solution of any of claims 1, 2, 3, or 4 wherein the mole fractions of units A and D are respectively: 0.50 to 0.75 and 0.05 to 0.15.

6. The aqueous solution of claim 5 wherein the concentration of polymer in solution is 5 to 20 weight %.

7. The aqueous solution of claim 6 wherein the weight average molecular weight of the polymer in solution is between 150,000 to 250,000 Daltons.

* * * * *